US006283202B1

(12) United States Patent
Gaines

(10) Patent No.: US 6,283,202 B1
(45) Date of Patent: Sep. 4, 2001

(54) APPARATUS FOR DISPENSING A CHEMICAL ADDITIVE INTO A WELL

(76) Inventor: Gene Gaines, RR1 Box B-27, Skidmore, TX (US) 78389

( * ) Notice: Subject to any disclaimer, the term of this patent is extended or adjusted under 35 U.S.C. 154(b) by 0 days.

(21) Appl. No.: 09/435,008

(22) Filed: Nov. 5, 1999

(51) Int. Cl.[7] ..... E21B 33/068
(52) U.S. Cl. ..... 166/75.15; 166/310
(58) Field of Search ..... 166/75.15, 310, 166/70, 90.1, 53

(56) References Cited

U.S. PATENT DOCUMENTS

| | | |
|---|---|---|
| 2,981,335 | 4/1961 | Bucy et al. . |
| 4,694,900 | 9/1987 | Behrens . |
| 4,785,880 | 11/1988 | Ashton . |
| 4,817,722 | 4/1989 | Montfort, Jr. et al. . |
| 5,188,178 | 2/1993 | Noyes . |
| 5,709,266 | 1/1998 | Kruse . |
| 5,813,455 | 9/1998 | Pratt et al. . |

*Primary Examiner*—Frank Tsay
(74) *Attorney, Agent, or Firm*—George R. Schultz; Madan, Mossman, Schultz & Sriram

(57) ABSTRACT

A chemical additive element or "soap stick" dispensing apparatus, particularly adapted for use in dispensing soap sticks into gas wells, includes an elongated tubular soap stick magazine member and a manual and gravity actuated flapper type check valve operable to hold a soap stick in the magazine member but operable in response to pressure equalization across the valve to open under the weight of the soap stick to dispense the soap stick into a wellbore. A bypass conduit is connected across the check valve and the magazine member and includes a remotely controllable or timer controlled motor operated valve operable to conduct wellbore pressure gas to a magazine chamber to equalize pressure across the check valve so as to allow the soap stick to be dispensed into the wellbore. The soap stick is loaded into the magazine member by removing a union type coupling from the upper end of the magazine member and a manual pressure release valve is connected to the bypass conduit between the motor controlled valve and the magazine chamber to depressurize the magazine chamber when a soap stick is to be inserted in the magazine member.

20 Claims, 2 Drawing Sheets

43
43s
43b
41a
41
41b
45
26
26a
56
54
48
58
54
10
24
22
20
46
30
28
50
50a
34o
3
3
30s
24:00
51
34
32
50b
30a
36
26
52
48
38
40
12a
18
12
16
14
13

APPARATUS FOR DISPENSING A CHEMICAL ADDITIVE INTO A WELL

FIELD OF THE INVENTION

The present invention pertains to an apparatus for dispensing a chemical additive, such as a "soap stick", into a well to stimulate or continue fluid production from the well.

BACKGROUND

In hydrocarbon producing wells, including gas wells in particular, fluid production is sometimes impaired by migration of water and other fluids into the wellbore. In production from gas wells, for example, the migration of water into the wellbore will reduce gas production significantly in a relatively short period of time, depending upon well conditions. A known technique for recovering or stimulating well production under such circumstances involves dispensing chemical additive "sticks" or "pellets" into the wellbore from manual or automatic dispensing devices mounted on the wellhead. Additive elements, such as so-called soap sticks, may be injected into the well to form a foamy mixture of any liquids, such as water, in the well to allow gas production to recover.

Various devices have been considered in the prior art for automatically dispensing or dropping the soap sticks or pellets into gas wells to stimulate production. Such devices may be manually or remotely controlled. However, there has been a continuing need for improvements in chemical additive or so-called soap stick dispensing devices, particularly for relatively low production wells or wells which are visited relatively frequently such as once a day or once every two days, for example. Even with this frequent visitation to the well it is still necessary and desirable to provide for a soap stick dispensing device which is uncomplicated and reliable in operation and which may be remotely controlled on a predetermined time duty cycle, or otherwise, to dispense one or more chemical additive or soap sticks into the wellbore.

Still further, the complexities of certain prior art devices are such that these devices do not lend themselves to reliable operation in unattended or remotely controlled wells which require soap stick dispensing devices. An important aspect of operating remotely located gas producing wells, for example, is the reliable operation of an additive or soap stick dispensing device, the ease with which the device may be installed, serviced and additive pellets or soap sticks reloaded into the device and the cost of adding such devices to a well which requires the type of treatment provided by the device. It is to these ends that the present invention has been developed.

SUMMARY OF THE INVENTION

The present invention provides an improved apparatus for dispensing chemical additive elements, such as so-called soap sticks, into a wellbore.

In accordance with one aspect of the present invention a chemical additive or soap stick dispensing apparatus is provided which is controlled to dispense a soap stick into a wellbore at a predetermined time and is operable to provide for reloading the apparatus reliably and easily with additional additive pellets or soap sticks when the well is serviced or inspected. A further aspect of the invention is that it can be easily installed with the change of a single piping or hammer union. In this regard the soap stick dispensing apparatus is adapted to mount on the wellhead in communication with the wellbore fluid (gas) production tubing and is uniquely configured to provide for equalizing fluid pressures within the apparatus so that chemical additive pellets or soap sticks may be released reliably into the wellbore. Further in this regard, the soap stick dispensing apparatus of the invention includes a retention valve for retaining a soap stick in the apparatus under fluid pressure acting on the valve closure member. The retention valve is preferably a so-called flapper type check valve and also advantageously includes a manual actuator for moving the valve toward a closed position. The retention valve also responds to substantial balance of fluid pressure forces acting thereon to open and release a soap stick into a wellbore.

In accordance with another aspect of the invention an improved soap stick dispensing apparatus is provided which relies on wellbore fluid pressure to retain the soap stick in the dispensing apparatus and to dispense the soap stick into the wellbore. A soap stick dispensing apparatus is provided wherein a reliable flapper type check valve is used to retain the soap stick in the dispensing device until it is released by equalization of fluid pressure on both sides of the soap stick and the check valve. A second flapper type check valve is preferably provided to vent a soap stick storage chamber and to allow the first mentioned check valve to remain closed until a timer controlled motor operated valve is actuated to allow pressure gas or other wellbore fluid to equalize the fluid pressure acting across the first mentioned check valve.

Still further, the present invention provides a soap stick dispensing apparatus which includes a significant number of components which are available as standard pipe and pipe fittings thereby minimizing the requirement for special fabricated components of the device.

Those skilled in the art will further appreciate the above-mentioned advantages and superior features of the invention together with other important aspects thereof upon reading the detailed description which follows in conjunction with the drawings.

DETAILED DESCRIPTION OF A PREFERRED EMBODIMENT

Figure 1:
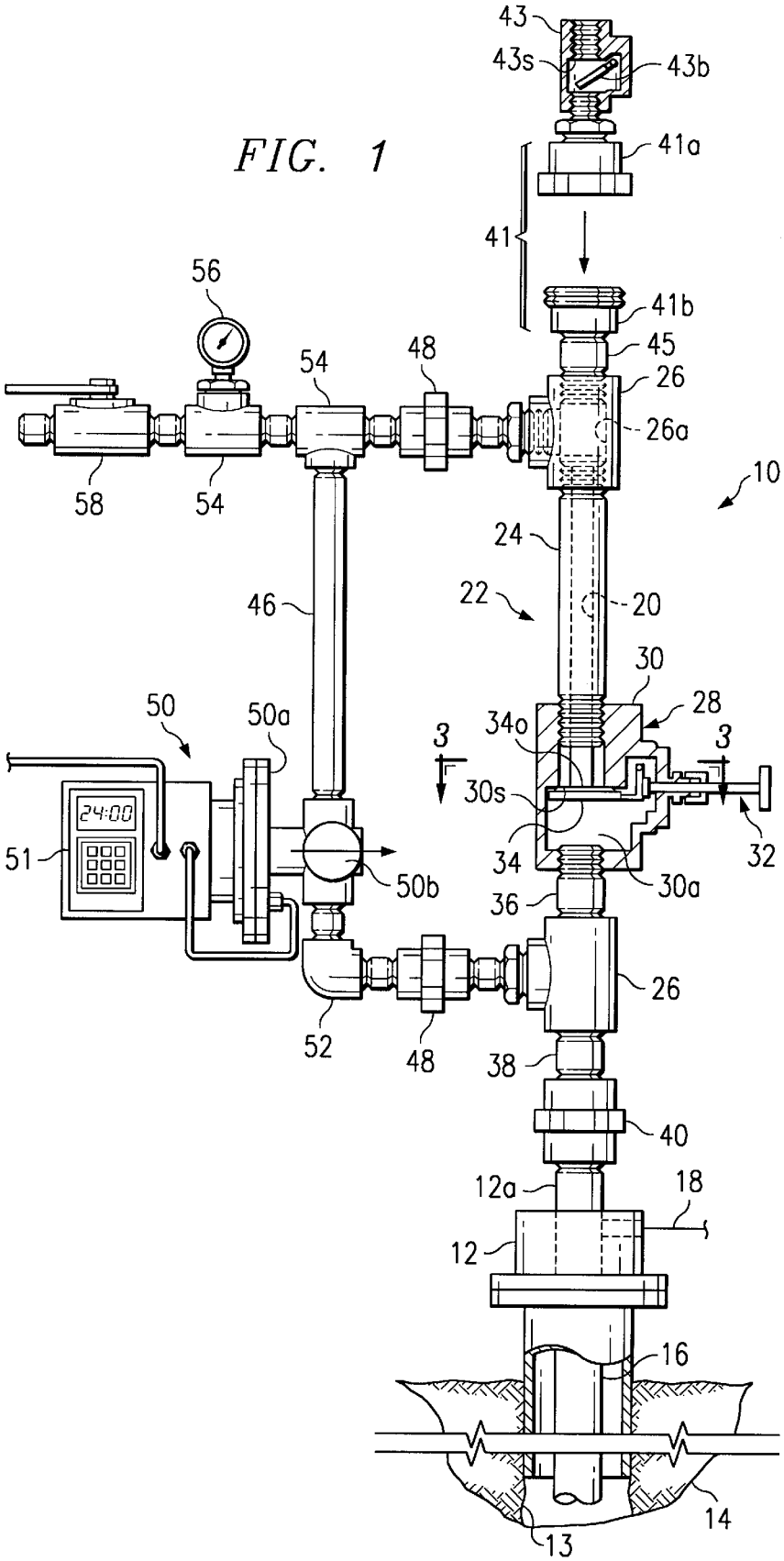
FIG. 1 is an elevation, partially sectioned, view of the soap stick dispensing apparatus of the present invention.

In the description which follows like parts are marked throughout the specification and drawing with the same reference numerals, respectively. The drawing figures are not necessarily to scale and certain conventional or commercially available elements may be shown in generalized or somewhat schematic form.

Referring to FIG. 1, a chemical additive or so-called soap stick dispensing apparatus in accordance with the invention is illustrated and generally designated by the numeral 10. The apparatus 10 is adapted for mounting on a wellhead 12 for a conventional gas well penetrating an earth formation 14 and including a production tubing string 16 extending therewithin for conducting wellbore fluids, primarily gas, to the surface and for discharge from the wellhead via a conventional flow line 18. The representation of the wellhead 12 is for illustrative purposes only. Basically, a wellhead adapted for use with the apparatus 10 is operable to include at least a short conduit section 12*a* on which the apparatus 10 may be mounted and adapted to provide a conduit path to the tubing string 16 for receiving a chemical additive element, such as a pellet or stick, commonly referred to as a soap stick. In FIG. 1 a soap stick 20 is shown disposed in the apparatus 10 for dispensing into the tubing string 16 and the wellbore 13 associated therewith.

The apparatus 10 is preferably characterized by a generally tubular soap stick retention magazine member, generally designated by the numeral 22, and including an elongated section of conventional schedule 80 nominal two-inch diameter steel pipe 24, a conventional schedule 80 Tee-fitting 26 and a flapper or disc type soap stick retention or check valve, generally designated by numeral 28, and shown in a central longitudinal section view in FIG. 1. Valve 28 includes a valve housing 30 which is modified to include a manually controllable actuator 32 for moving a generally disc shaped valve closure member 34 to a closed position. Actuator 32 includes a handle 33 at its distal end, as shown in FIG. 1. The closure member 34 includes a circular o-ring seal element 34*o*, FIGS. 1 and 3, supported thereon and operable to engage a seat 30*s* in fluid tight relationship. A closure member support arm 34*a* is operable to support the closure member 34 for pivotal movement within a chamber 30*a* formed in the housing 30. A suitable pivot pin or the like 36, see FIG. 2, supports closure member 34 for movement between open and closed positions within valve chamber 30*a*. Valve housing 30 is connected to a short section of pipe or tubing 36 which in turn is connected to a second conventional Tee-fitting 26 and which, in turn, is connected to a section of tubing or pipe 38. Tubing or pipe section 38 is connected to a conventional so-called hammer union type coupling 40 which is adapted to mount the apparatus 10 on the pipe section 12*a*, as illustrated.

The Tee-fittings 26 are each connected to a bypass conduit assembly 46 by conventional conduit and hammer union type separable coupling assemblies 48 which are each adapted to be connected to the respective Tee-fittings 26, as shown. A pneumatically operated motor valve 50 of a type commercially available is disposed in the bypass conduit assembly 46, as shown, between a right angle elbow fitting 52 and a conventional Tee-fitting 54. Other embodiments might include an electric solenoid or motor valve as a replacement for pneumatically operated valve 50. Tee-fitting 54 is connected to a further Tee-fitting 54 having a conventional pressure gauge 56 mounted thereon. A manually actuatable vent valve 58 is also connected to the Tee-fittings 54, as shown in FIG. 1, for venting fluid from the bypass conduit assembly 46, and magazine chamber 26*a* formed in the Tee-fitting 26 above the magazine conduit 24 and including the magazine conduit 24. Chamber 30*a* of the retention valve 28 may also be vented through valve 58 depending on the position of the valve closure member 50*b* for the motor operated valve 50 and the closure member 34, respectively.

Pneumatically operated motor valve 50 may be of a type commercially available such as a model PQC128 manufactured by Fischer Controls of Marshall Town, Iowa. Valve 50 includes a timer type controller 51 which is operable to deliver a control signal to valve operator 50*a* at a predetermined time to move the valve closure member 50*b* between open and closed positions. Timer control 51 may be powered by a conventional electrical connection or by a battery or solar panel completely freeing the invention from the need for an electrical power connection.

Referring further to FIG. 1, the soap stick dispensing apparatus 10 also includes a conventional hammer union type coupling 41, shown disassembled in FIG. 1, and connected to a disc or flapper type check valve 43 including a pivoting closure member 43*b* operable to close against a seat 43*s*. Union member 41*a* is connected directly to valve 43 and union member 41*b* is connected to upper Tee-fitting 26 via a short conduit section 45. When the union members 41*a* and 41*b* are threadedly connected in a known manner check valve 43 is operable to prevent pressure fluid from escaping from chamber 26*a* to atmosphere. When chamber 26*a* is vented to atmosphere through valve 58, with closure member 50*b* of valve 50 closed and closure member 34 seated against seat 30*s*, FIG. 1, check valve 43 is open and union member 41*a* may be removed from union member 41*b* to allow placing a soap stick 20 in chamber 26*a*. Depending upon the length of magazine member 24 and soap stick 20, plural soap sticks may be inserted in chamber 26*a* in end to end relationship.

Figure 2:
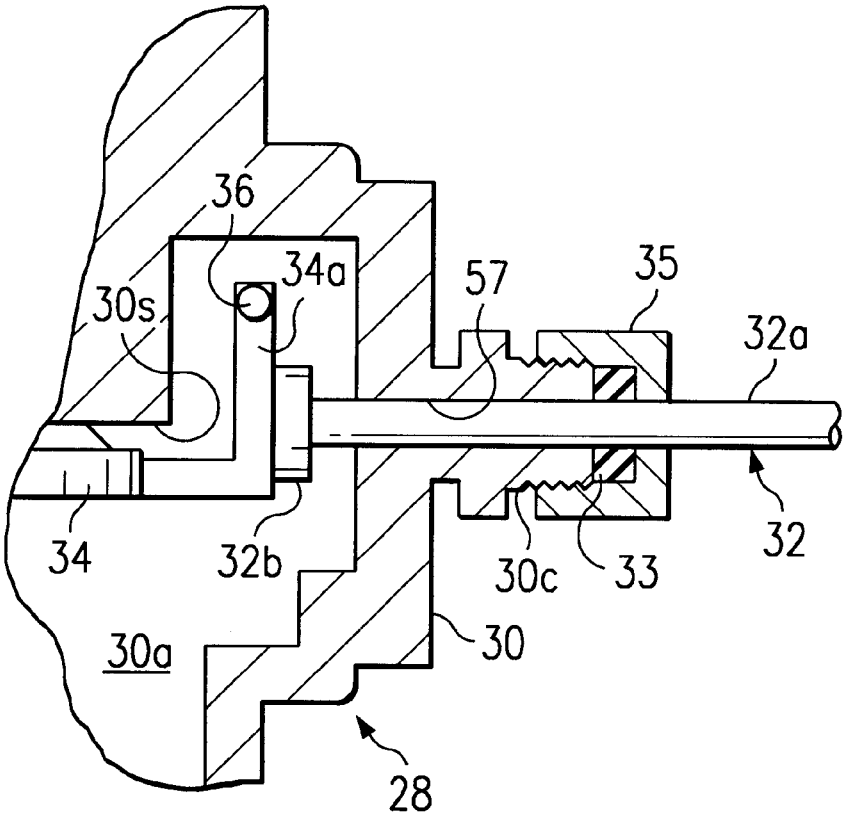
FIG. 2 is detail section view of a portion of the soap stick retention valve and valve actuator.
Figure 3:
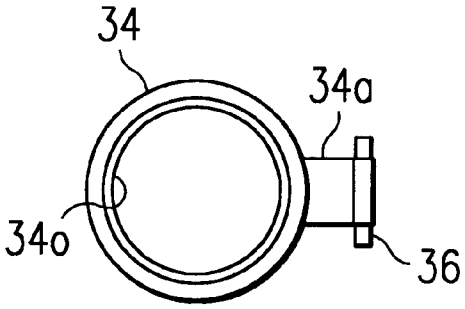
FIG. 3 is a detail section view taken along line 3—3 of FIG. 1.

Referring briefly to FIG. 2, actuator 32 is characterized by an elongated rod 32*a* which projects through valve housing 30 by way of a suitable bore 57 and includes a flanged end part 32*b* engagable with arm 34*a* of closure member 34. A suitable threaded boss 30*c* is formed on housing 30 for slidably receiving actuator rod 32*a* therein. A resilient packing 33 is retained between boss 30*c* and an adjustable packing nut 35 to prevent leakage of pressure fluid from chamber 30*a* to the exterior of valve 28. However, actuator rod 32*a* may be moved to engage arm 34*a* to move closure member 34 to the closed position as shown in FIG. 1 and also FIG. 2. If fluid pressure forces acting on opposite sides of closure member 34 are equalized, the combined weight of a soap stick 20 and closure member 34 is sufficient to overcome friction forces acting on rod 32*a* to cause closure member 34 to move to an open position allowing the soap stick 20 to drop through the dispensing apparatus 10 into tubing 16 and subsequently into wellbore 13.

The operation of soap stick dispensing apparatus 10 will now be described. With the apparatus 10 mounted on a conventional gas well, as illustrated in FIG. 1, a soap stick 20 may be inserted in the chamber 26*a* and magazine conduit 24 by first moving the actuator 32 to move closure member 34 against valve seat 30*s* to assure that the closure member is in the closed position. Alternatively, pressure gas flowing upward through tubing 16 may enter chamber 30*a* and act on the closure member 34 to move it to the closed position if pressure gas has been rapidly vented from chamber 26*a* above valve seat 30*s*.

With valves 28 and 50 in the closed position vent valve 58 may be opened to decrease any fluid pressure in chamber 26*a* thereby assuring that closure member 34 will remain closed due to a pressure differential acting thereacross. At this time union member 41*a* and check valve 43, in assembly, may be removed from the apparatus 10 followed by placing one or more soap sticks 20 in magazine member 24 into the position shown in FIG. 1. Union member 41*a* is then threadedly reconnected to member 41*b*, and valve 58 is moved to the closed position. Pressure gauge 56 will indicate the pressure condition in chamber 26*a* during the aforementioned operations to verify that pressure has decreased in chamber 26*a* or that pressure gas from tubing string 16 has entered chamber 26*a*.

Timer 51 for valve 50 may be set to a predetermined time for the soap stick 20 to be dispensed into the wellbore. Typically, if a well is visited once every twenty-four hours a soap stick may be manually dispensed into the well during the attendant's visit and the timer may be set to dispense another soap stick twelve hours later. Accordingly, once a soap stick 20 is loaded into the apparatus 10 and the timer 51 is set for actuation of valve 50 twelve hours later the attendant may leave the well site with the assurance that a soap stick 20 will be automatically dispensed into the well at the prescribed interval.

With valves 50 and 58 in their closed positions and valve closure member 34 engaged with valve seat 30*s*, chamber 26*a* may still be vented thanks to check valve 43. In this way minor leakage from valve 28 or valve 50 will not pressurize chamber 26*a* resulting in premature release of soap stick 20. Check valve 43 preferably includes the pivotal flapper type closure member 43*b* responsive to pressure fluid acting thereon to close against seat 43*s* to prevent fluid from escaping chamber 26*a* therethrough. When timer 51 actuates valve 50 to move to the open position, pressure gas is conducted at a sufficient flow rate through bypass conduit assembly 46 into chamber 26*a* forcing check valve 43 to close and substantially equalizing the fluid pressure in chamber 30*a* and chamber 26*a*, including the interior of magazine conduit member 24.

With fluid pressure forces equalized across the closure member 34, the weight of soap stick 20 at least will force the closure member 34 to swing to an open position well out of the way of soap stick 20 and allowing the soap stick to drop into and through the tubing string 16 into the wellbore 13. Valve 50 may be set to re-close a short time after the soap stick 20 has been dispensed or valve 50 may be manually closed when an operator or attendant next visits the well site. The soap stick loading process is then repeated as described above.

Actuator 32 may, if desired, be mechanically linked to closure member 34 in such a way that the closure member can be moved to an open position by movement of the actuator rod 32*a* as well as moved to a closed position also by operation of the actuator rod 32*a*. With the actuator rod 32*a* mechanically linked to the closure member movement of the rod to the right, viewing FIGS. 1 or 2, may overcome pressure forces acting on closure member 34 to move it to the open position, if desired.

The soap stick dispensing apparatus 10 is reliable in operation in that the reliable cylindrical disc or flapper type check valve 28 will open in response to pressure force equalization across closure member 34 and the weight of a soap stick 20 acting thereon without the likelihood of the soap stick being stuck in the magazine conduit member 24 or the valve housing 30. The operator or attendant of the well may be sure that the closure member 34 is in a closed position by moving the actuator 32 to the valve closed position, that is to the left viewing FIGS. 1 or 2.

Those skilled in the art will recognize that the soap stick dispensing apparatus 10 is easily fabricated of conventional reliable fittings and components, is easily assembled, disassembled and installed and is well suited to operation at remotely controlled or infrequently visited wells. Moreover, the apparatus 10 may be constructed using a substantial number of commercially available components, including standard commercially available pipe fittings and valves, for example.

Although a preferred embodiment of a chemical additive or soap stick dispensing apparatus has been described herein, those skilled in the art will recognize that various substitutions and modifications may be made without departing from the scope and spirit of the appended claims.

What is claimed is:

1. An apparatus for dispensing a chemical additive element, such as a soap stick, into a wellbore comprising:

an elongated tubular magazine member for holding at least one soap stick;

a first fitting operably connected to said magazine member for mounting said apparatus on a wellhead for placing said magazine member in communication with a tubing extending from said wellhead into a wellbore;

a soap stick retention valve disposed between said magazine member and said first fitting and including a valve closure member operable, in a closed position, to retain said soap stick in said magazine member, said retention valve forming a first chamber between said closure member and said first fitting;

a second fitting forming a second chamber, generally above said soap stick and in communication with said magazine member;

a bypass conduit connected to said apparatus to provide fluid flow between said fittings and around said closure member of said retention valve to substantially equalize fluid pressure in said chambers; and a driver valve operable to be in a closed position to prevent fluid flow through said bypass conduit to said second chamber and responsive to a signal to move to an open position to communicate pressure fluid to said second chamber to substantially equalize pressures in said chambers to allow said soap stick to move said closure member of said retention valve to an open position to dispense said soap stick into said wellbore.

2. The apparatus set forth in claim 1 including:

a vent valve operably connected to said second chamber for venting pressure fluid from said second chamber to provide a pressure differential between said chambers when said driver valve is in a closed position.

3. The apparatus set forth in claim 2 including:

a pressure responsive valve operably in communication with said second chamber and responsive to pressure fluid communicated to said second chamber to move to a closed position to allow said second chamber to be pressurized to substantially equalize the fluid pressure in said chambers.

4. The apparatus set forth in claim 3 including:

a third fitting operably connected to said second fitting and comprising a union including two separate members which may be releasably coupled by a threaded coupling, one of said members of said third fitting supporting said pressure responsive valve.

5. The apparatus set forth in claim 1 wherein:

said retention valve comprises a one-way check valve and said closure member is responsive to one of flow of pressure fluid acting thereon and an actuator to move to a closed position to retain said soap stick in said magazine member.

6. The apparatus set forth in claim 5 wherein:

said retention valve includes a manual actuator for moving said closure member to a closed position to retain said soap stick in said magazine member and to prevent flow of pressure fluid from said wellbore into said magazine member.

7. The apparatus set forth in claim 5 wherein:

said closure member comprises a generally cylindrical disk mounted for pivotal movement between a closed position for retaining said soap stick in said magazine member and an open position for releasing said soap stick to be dispensed into said wellbore.

8. The apparatus set forth in claim 1 wherein:

said bypass conduit is operably connected to said magazine member by spaced apart separable couplings.

9. The apparatus set forth in claim 1 wherein:

said magazine member comprises an elongated cylindrical conduit interposed said retention valve and a Tee-fitting, said Tee-fitting defining, in part, said second chamber.

10. The apparatus set forth in claim 1 wherein said driver valve is a pneumatically operated motor valve.

11. The apparatus set forth in claim 1 wherein said driver valve is an electric solenoid.

12. The apparatus set forth in claim 1 wherein said signal is generated by a controller.

13. The apparatus set forth in claim 1 wherein said controller is a timer.

14. An apparatus for dispensing an elongated chemical additive element into a wellbore comprising:

a magazine member forming a first chamber for holding at least one additive element;

a retention valve connected to said magazine member and including a disc type closure member mounted for pivotal movement within a retention valve housing between a closed position for retaining said additive element in said magazine member and an open position for dispensing said additive element into a wellbore;

a bypass conduit adapted to conduct fluid flow to said first chamber to bypass said retention valve and to substantially equalize fluid pressure forces acting on said closure member;

an actuator for said closure member for moving said closure member between valve open and closed positions, at will; and a motor valve operable in a closed position to prevent fluid flow through said bypass conduit and responsive to a control signal to move to an open position to communicate pressure fluid to said magazine member to substantially equalize pressure forces acting on said closure member of said retention valve to allow said additive element to move said closure member of said retention valve to an open position to dispense said additive element into said wellbore.

15. The apparatus set forth in claim 14 including:

a manually actuatable vent valve operably connected to said magazine member for venting pressure fluid therefrom to provide a sufficient pressure differential across said closure member of said retention valve to hold said closure member of said retention valve in a closed position to retain an additive element in said magazine member.

16. An apparatus for dispensing a soap stick into a wellbore comprising:

an elongated tubular magazine member for holding at least one soap stick;

a first fitting operably connected to said magazine member for mounting said apparatus on a wellhead for placing said magazine member in communication with a tubing extending from said wellhead into a wellbore;

a soap stick retention valve disposed between said magazine member and said first fitting and including a valve housing defining a first chamber, a valve closure member mounted in said first chamber and operable, in a valve closed position, to retain said soap stick in said magazine member;

a second fitting connected to said magazine member and disposed generally above said soap stick and forming a second chamber with said magazine member;

a bypass conduit connected to said apparatus by third and fourth fittings to provide fluid flow between said chambers to equalize fluid pressure in said chambers;

a motor operated valve operable to be in a first position to prevent fluid flow through said bypass conduit to said second chamber and responsive to a signal to move to an open position to communicate pressure fluid to said second chamber to substantially equalize pressures forces acting on said closure member to allow said soap stick to move said closure member to an open position to dispense said soap stick into said wellbore; and a vent valve operably connected to said second chamber for venting pressure fluid from said second chamber to provide a pressure differential between said chambers when said motor operated valve is in a closed position.

17. The apparatus set forth in claim 16 including:

a pressure responsive valve operably in communication with said second chamber and responsive to pressure fluid communicated to said second chamber to move to a closed position to allow said second chamber to be pressurized to substantially equalize the fluid pressure in said chambers.

18. The apparatus set forth in claim 17 including:

a coupling for connecting said pressure responsive valve to said magazine member, said coupling including separable members for opening said magazine member to receive a soap stick therein.

19. The apparatus set forth in claim 17 wherein:

said pressure responsive valve includes a flapper type check valve operable in an open position to vent pressure fluid from said first chamber.

20. The apparatus set forth in claim 16 wherein:

said retention valve includes a manual actuator for moving said closure member to a closed position to retain said soap stick in said magazine member and to prevent flow of pressure fluid from said wellbore into said magazine member.

* * * * *